United States Patent [19]

Yang

[11] Patent Number: 4,526,047

[45] Date of Patent: Jul. 2, 1985

[54] ENERGY ABSORBER

[75] Inventor: Elmer C. Yang, Orange, Calif.

[73] Assignee: Pacific Scientific Company, Anaheim, Calif.

[21] Appl. No.: 447,704

[22] Filed: Dec. 7, 1982

[51] Int. Cl.[3] ..... F16H 21/16; F16H 21/40; B60T 7/12; F16D 51/00

[52] U.S. Cl. ..... 74/25; 74/99 A; 188/129; 188/130; 188/77 W; 188/378; 188/380; 267/137

[58] Field of Search ..... 267/136, 137; 188/378, 188/380, 271, 167, 302, 129, 130, 77 W; 74/25, 99 A

[56] References Cited

U.S. PATENT DOCUMENTS

| | | | |
|---|---|---|---|
| Re. 29,221 | 5/1977 | Yang | 188/378 |
| 3,059,727 | 10/1962 | Fuchs | 188/381 |
| 3,229,544 | 1/1966 | Haller | 74/424.8 R |
| 3,329,242 | 7/1967 | Minarick et al. | 188/134 |
| 3,479,890 | 11/1969 | Howell | 74/89.15 |
| 3,603,433 | 9/1971 | Keathley et al. | 188/372 |
| 3,631,951 | 1/1972 | Quenneville | 188/271 |
| 3,659,682 | 5/1972 | Meyer et al. | 188/134 |
| 3,701,401 | 10/1972 | Palma et al. | 188/134 |
| 3,730,015 | 5/1973 | Cornell | 74/424.8 R |
| 3,734,253 | 5/1973 | Derossi | 192/8 C |
| 3,762,227 | 10/1973 | Bohnhoff | 74/89.15 |
| 3,876,040 | 4/1975 | Yang | 188/378 |
| 3,983,965 | 10/1976 | Wright, Jr. | 188/380 |
| 4,103,760 | 8/1978 | Yang | 188/378 |
| 4,105,098 | 8/1978 | Klimaitis | 188/378 |
| 4,185,720 | 1/1980 | Wright, Jr. et al. | 188/378 |
| 4,287,969 | 9/1981 | Misumi et al. | 188/134 |
| 4,350,232 | 9/1982 | Yang | 248/562 |
| 4,431,093 | 2/1984 | Yang | 188/378 |

FOREIGN PATENT DOCUMENTS

| | | | |
|---|---|---|---|
| 0068942 | 1/1983 | European Pat. Off. | 267/136 |

*Primary Examiner*—Lawrence J. Staab
*Assistant Examiner*—Michael D. Bednarek
*Attorney, Agent, or Firm*—Knobbe, Martens, Olson & Bear

[57] ABSTRACT

An energy absorber strut includes a pair of elongated drive nuts threaded internally to mate with a drive screw having high lead threads on opposite ends so that outward movement of the nuts on the screw rotates the screw in one direction and inward movement rotates the screw in the opposite direction. A mandrel mounted to rotate with the screw is restrained from rotation by a capstan spring which surrounds and grips it. Prestressed torsion springs connected to the ends of the capstan spring permit it to unwind slightly and drag with respect to the mandrel when the torsion springs are subjected to a predetermined torque.

10 Claims, 2 Drawing Figures

ENERGY ABSORBER

BACKGROUND OF THE INVENTION

This invention relates to energy absorbing devices, movement dampers, and load limiters, and especially those that are all mechanical as opposed to hydraulic. Such devices are useful in many applications, dampers being particularly adapted to dampen recoil forces generated by firing a machine gun.

While hydraulic devices have often been used for damping recoil forces from guns or other apparatus, and such devices have certain advantages, they have the major disadvantage of requiring hydraulic fluid and the accompanying seals, which inevitably leak and require replacement. Systems that are all mechanical avoid these problems. Typically, such systems provide damping by virtue of the friction of sliding surfaces, and are sometimes referred to as Coulomb dampers. The damping provided is based on the coefficient of friction and is often thought of as basically a constant frictional force since the coefficient of friction is often referred to as a constant for a particular material. In fact, however, the coefficient of friction varies significantly during operation when subjected to variations in temperature, humidity, wear, foreign matter on the sliding surfaces, and other factors. In addition, the difference between static and dynamic friction is very significant. Consequently, a device relying on friction typically requires a much larger initial force or load to start movement than is required to continue movement.

There are many different types of mechanical dampers and energy absorbers, but nevertheless, a need still exists for improvements in such devices. It is particularly desirable that a recoil damper provide a substantially constant drag or damping effect from a standpoint of reliability and design of the system. That is, the requirements for a particular use may be accurately and efficiently met with a constant drag device. In addition, a constant drag device can function as an accurate load limiter which prevents movement of a structure until a predetermined load is applied. It is, of course, also desirable that such devices be compact, versatile and durable.

SUMMARY OF THE INVENTION

Briefly stated, the present invention comprises a mechanical device that provides a substantially constant drag or resistance to movement. The device employs a braking arrangement that prevents extension or retraction of a strut until a predetermined load is applied. Spring forces are employed to determine a load level at which the brake starts to unload and is allowed to slide. Such level is substantially constant not being subject to the changes in the coefficient of friction of the braking surfaces. The invention also encompasses a method of absorbing energy for damping or load limiting.

In one form of the invention, axial movement of a strut member is converted into rotation of another member, such as a mandrel, having a generally cylindrical surface. Movement in one axial direction rotates the mandrel in one direction and movement in the opposite axial direction rotates the mandrel in the opposite direction. A capstan spring is employed as a brake element which frictionally engages the cylindrical surface to restrict or prevent movement until the capstan spring is allowed to drag with respect to the cylindrical surface. One end of the capstan spring is interconnected to spring means, such as a torsion spring, that initially holds the end of the capstan spring stationary but then moves to permit the capstan spring to start to unwind and hence drag at a predetermined load level as determined by the torsion spring.

Preferably, the strut includes a pair of elongated drive nuts that are threaded internally with a high lead thread that mates with corresponding threads on the ends of a drive screw on which the mandrel is mounted to be rotated with the drive screw. Each drive nut is permitted to slide axially within a surrounding guide that cannot rotate with respect to the nut. A torsion spring grips the cylindrical exterior of each of the guides with one end of the torsion spring anchored in a flange on the guide and the other end of the spring captured within a tubular connecting member that is slideably positioned on the guide. One end of the capstan spring is secured to this connecting member while the other end of the capstan spring is secured to a similar connecting member on the other guide. An outer tube encloses the components and is secured to the guide flanges.

In operation, the strut members are initially prevented from moving in that the torsion springs hold the ends of the capstan spring stationary and it firmly grips the mandrel. Attempted rotation of the mandrel merely tightens the grip. However, when the torque caused by the drive screw on the mandrel reaches a predetermined level, one of the torsion springs starts to unwind slightly to permit the capstan spring to start to unwind and drag with respect to the mandrel. As soon as the capstan spring starts to unwind reducing the torque on the torsion spring, the capstan spring once more starts to wind and grip more tightly until allowed to drag again. This slippage occurs in a controlled manner, therefore limiting the damping effect.

With a strut providing a substantially constant drag, the energy being absorbed or work performed is simply the distance moved times the drag force. This is helpful in designing the device needed for a particular damping requirement. Conversely, if an object can only be allowed to move a certain distance, the necessary drag to accomplish this can be readily and reliably determined.

By employing torsion springs of substantially the same strength, the damping effect will be approximately the same in either retracting or extending movement. However, this may be varied as desired to provide greater resistance to movement in one direction than the other.

Another advantage of the device, in addition to the substantially constant drag provided, is that it is very reliable and requires little if any maintenance during its expected service lifetime.

DETAILED DESCRIPTION OF A PREFERRED EMBODIMENT

Figure 1:
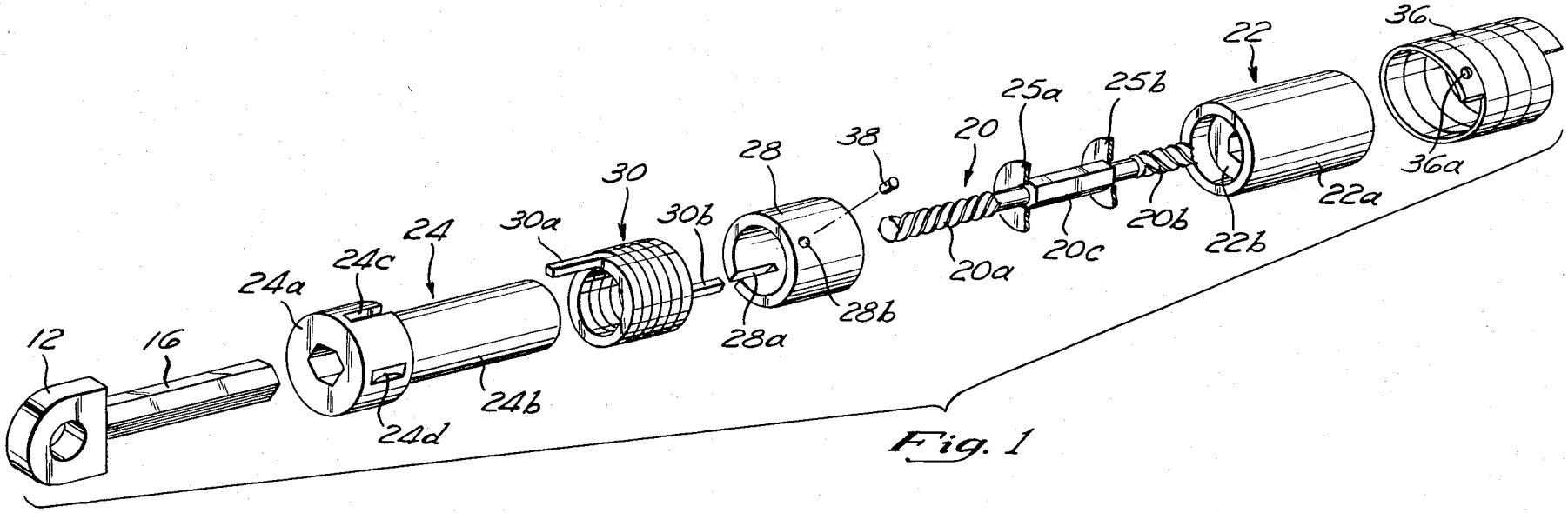
FIG. 1 is an exploded perspective view of the components of one end of the strut of the invention with its outer shell removed and including the entire central mandrel.

Referring to the drawings, it may be seen from FIG. 2 that there is illustrated a damper in the form of an elongated strut which is basically symmetrical in that the left half is substantially like that of the right half except for some thread configurations, as will be described. This includes a pair of end tongues or plugs 12 and 14 for connection between a support and a machine gun or other apparatus having recoil movement which is to be snubbed or damped. The tongues include a threaded shank 12*a* as shown for the tongue 12 in FIG. 2. This shank threads into the outer end of an elongated tubular drive nut 16 illustrated on the left end of the strut in FIGS. 1 and 2, and a similar nut 18 is shown on the right end of the strut in FIG. 2 connected to the tongue 14. The interior of the opposite ends of the nuts, that is, the ends extending towards the center of the strut, are each formed with a high lead thread as shown at 16*a* in FIG. 2 for the nut 16. The high lead thread for the nut 18 is identical to that for the nut 16 except that one is a lefthand thread and the other is a righthand thread.

An elongated drive screw 20 extends axially within the strut, with one end of the screw having a high lead thread 20*a* which mates with the thread 16*a* of the nut 16 and the other having a high lead thread 20*b* which mates with the thread of the nut 18. The central section 20*c* of the screw is formed with a hexagonal cross section.

Positioned on the central section of the screw is an elongated tubular mandrel 22 having an interior bore with a hexagonal configuration which mates with the section 20*c* of the drive screw so that rotation of the screw also rotates the mandrel. The mandrel 22 has an exterior cylindrical brake surface 22*a*. Each end of the mandrel has a cylindrical recess 22*b*.

Slidably positioned on the drive nut 16 is an elongated tubular sleeve-like guide 24 which is identical to a sleeve-like guide 26 slidably mounted on the nut 18. As may be seen from FIG. 1, the interior of the guide has a hexagonal cross section which mates with the exterior of the nut 16, that permits axial movement of the two components but prevents relative rotation. The outer end of the guide includes a radially extending flange 24*a*, which also has considerable axial depth. The shank 24*b* of the guide 24 is smooth and cylindrical. As may be seen in FIG. 2, the inner end of the shank 24*b* slides within the axial recess 22*b* in the mandrel 22.

A washer 25*a* is positioned on the drive screw 20 between the inner end of the guide shank 24*b* and the bottom of the recess 22*b*. The inner diameter of the washer is smaller than the hexagonal cross section 20*c* so that it prevents the drive screw from moving axially during reciprocating of the drive nuts. A similar washer 25*b* is located on the other end of the screw central section 20*c*.

Slidably positioned on the exterior of the guide shank 24*b* is a tubular connecting member 28. An identical member 29 is positioned on the shank 26*b* of the guide 26.

Also positioned respectively on the shank of each of the guides 24 and 26 is a torsion spring 30 and 32. As may be seen, the torsion spring 30 comprises a plurality of coils terminating on one end with an axially extending tang 30*a* which is anchored within a corresponding groove 24*c* in the flange 24*a*. A tang 30*b* on the other end of the spring extends axially in the opposite direction, that is, toward the center of the strut, and is received in an axially extending slot 28*a* in the connecting member 28, with the slot being open on its end towards the torsion spring 30 to receive the spring tang 30*b*. The torsion spring 32 on the other end of the strut has a similar axially extending spring tang 32*b* which mates within a corresponding slot in the member 29, and the other end of the spring 32 is anchored to the guide 26.

The inner diameter of each of the torsion springs when at rest before being mounted on a guide is smaller than the guide shank, and therefore, the spring must be unwound somewhat when placed on the guide. When released, the spring then grips the guide such that a predetermined torque is required to move a spring end in an unwinding direction relative to the other end, and movement in the winding direction is prevented.

A capstan spring 36 having a plurality of coils having a thin flat generally rectangular cross section is wound around the cylindrical surface 22*a* of the mandrel 22. The left end of the spring 36 extends onto the connecting member 28 and is anchored thereto by means of a pin 38 which extends through a suitable hole 36*a* in the end coil of the capstan spring and extends into a mating hole 28*b* in the member 28. The opposite end, that is, the righthand end, of the capstan spring 36, is similarly anchored to the member 29.

Figure 2:
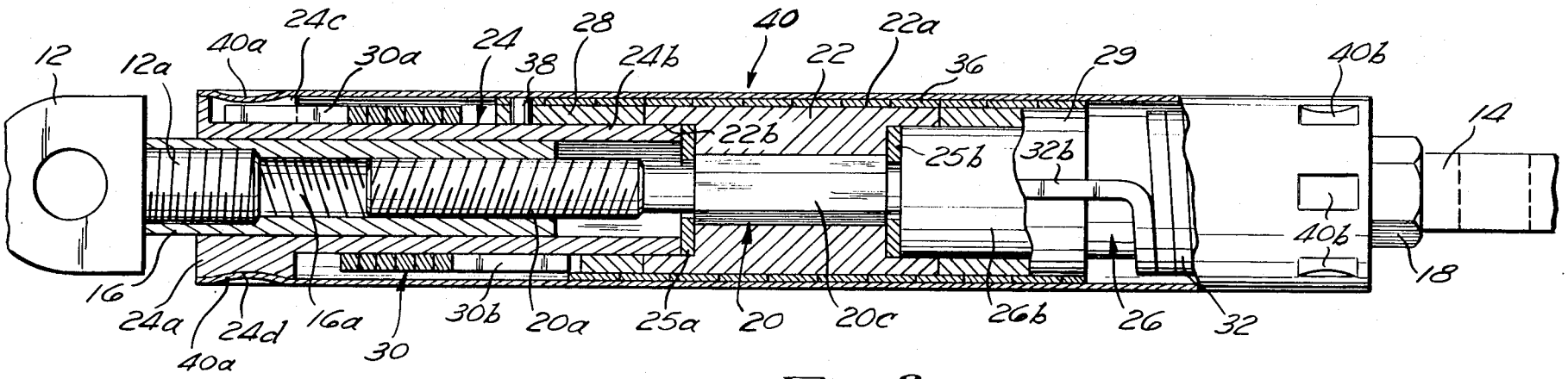
FIG. 2 is a side elevational view of the strut with most of it being shown in cross section along the longitudinal axis of the strut.

As may be seen from FIG. 2, a tubular cover or housing 40 extends from the outer end of the guide 24 to the outer end of the guide 26 thereby enclosing all of the components within that area. When the components are assembled, the guides 24 and 26 are angularly oriented with respect to each other so that the capstan spring grips the mandrel 28 sufficiently to provide braking action on the mandrel if it is rotated. With the end guides in this desired position, the housing 40 is secured to the guides by staking end portions 40*a* of the housing into a series of recesses 24*d* in the circumferential surface of the flange 24*a* of the guide 24, and portions 40*b* into similar recesses in the flange of the guide 26. Note that the recesses 24*d* have axially extending side walls that are abruptly angled with the flange periphery so as to positively position the guides in a circumferential direction.

OPERATION

In use, the tongue ends of the strut are connected to a gun or other device whose recoil is to be dampened. The strut is illustrated in FIG. 2 in its shortest length. Applying a tension force to the strut plug ends 12 and 14 imparts a torque on the drive screw 20 by virtue of the high lead threads 20*a* and 20*b* on the drive screw and the corresponding threads on the interior of the drive nuts 16 and 18. Since one end of the drive screw has a lefthand thread and the other a righthand thread, applying a tension load to the drive nuts 16 and 18 cause them to both want to rotate the drive screw 20 in the same direction. The hexagonal cross section of the nuts prevents them from rotating within the fixed guides 24 and 26. Urging the drive nuts towards each other in a strut retracting or shortening direction reverses the torque on the drive screw.

The torque on the drive screw is likewise transmitted to the mandrel 22 by virtue of its inner hexagonal cross section mating with the cross section of the central portion 20*c* of the drive screw 20. The mandrel, however, initially cannot rotate because it is gripped by the capstan spring 36. The capstan spring, of course, is urged to move with the mandrel; but since its ends are anchored to the guides 24 and 26 by way of the torsion springs 30 and 32 and connecting members 28 and 29, the capstan spring ends cannot rotate with the mandrel.

Instead, the gripping force provided by the capstan spring is amplified as the mandrel attempts to rotate.

The capstan spring is wound opposite to the two torsion springs 30 and 32. As illustrated in the drawing, the capstan spring has a lefthand configuration and the torsion spring has a righthand wind. With such an arrangement, torque by the mandrel causes the capstan spring to produce a winding torque on one torsion spring and an unwinding torque on the other torsion spring. Since the spring receiving the winding torque is already prestressed to grip its guide, it cannot be wound further, its end tang received in a connecting member is essentially stationary. However, the other torsion spring being subjected to an unwinding torque will move when subjected to a predetermined torque. That is, axially extending ends 30*b* or 32*b* of a torsion spring will move circumferentially a small amount in a manner to permit the capstan spring 36 to unwind slightly, thus reducing the frictional grip on the mandrel. The result of this action and reaction of the capstan spring and torsion springs is that the mandrel is allowed to rotate with a predetermined drag thereon by the capstan spring as determined by the torsion springs.

Rotation of the mandrel in one direction will cause one of the torsion springs to determine the drag level whereas rotation of the mandrel in the opposite direction will cause the other torsion spring to determine the drag force. For most applications, the same drag force will be desired in both directions such that the torsion springs may be identical. On the other hand, the torsion springs may be given pre stress loads or torsion springs of different strengths may be employed, with the result that a drag force of one level is created upon the strut in compression and a different level is created on the strut under tension.

A principal advantage of the strut is that other than an initial frictional drag, the damping provided by it is determined by the torsion springs rather than by the frictional cooperation between the capstan spring and the mandrel. Consequently, the drag provided is essentially constant and is independent of changes in the coefficient of friction between the capstan spring and the cylindrical surface of the mandrel. This avoids the problem of an initial static friction being greater than dynamic friction. As mentioned above, the device is not only a recoil damper, but a load limiter which prevents motion of an object until a predetermined initial force is provided, and then absorbs energy or performs work at a known linear rate.

Another advantage of the strut is that all of the components may be made of metal and are consequently very durable such that the device can be repeatedly subjected to heavy recoil forces. While various materials may be employed, it is preferable that the capstan spring be made of a phosphorous bronze material and that the mandrel surface be chrome plated. Naturally, the drag that a strut may be able to provide is dependent upon the particular size of components and spring forces selected. In an early prototype version of the strut, the torsion springs were selected so that the capstan spring prevented movement of the strut until it was subjected to a load of 300 pounds.

What is claimed is:

1. An energy absorbing device comprising:

an axially movable strut member for receiving energy to be absorbed or movement to be damped;

means forming a cylindrical brake surface;

a capstan spring having one or more coils frictionally engaging the braking surface to resist relative movement between the spring and said surface;

means for translating axial movement of said strut member into rotation of one of said cylindrical surface and said capstan spring; and preloaded spring means connected to one end of the capstan spring in a manner such that the spring means will permit the capstan spring to unload slightly at a predetermined torque and drag with respect to the cylindrical surface.

2. The device of claim 1 wherein said strut member includes an elongated drive nut having means mounted on one end for connection to the device whose energy is to be absorbed, said translating means including a drive screw having a high lead thread formed on one end which mates with a corresponding high lead thread formed on the interior of said nut wherein axial movment of the nut relative to the screw will rotate the screw, and including a mandrel mounted for axial movement on a portion of said screw, with said screw portion and said mandrel being formed to cause the mandrel to rotate with the screw, said cylindrical brake surface being formed on the exterior of the mandrel with said capstan spring gripping said mandrel.

3. The device of claim 2 including an elongated sleeve-like guide mounted on said nut in a manner that permits the nut to move axially with respect to the guide but the nut is prevented from rotating with respect to the sleeve, and wherein said spring means comprises a torsion spring positioned on and gripping said guide with a predetermined load and with one end of the torsion spring anchored to said guide.

4. The device of claim 3 including a cylindrical connecting member slidably mounted on said guide between said torsion spring and the capstan spring, one end of the capstan spring being connected to said member and one end of the torsion spring being conncected to the member whereby a torsional load transmitted to the capstan spring by way of said mandrel is transmitted through the cylindrical member to the torsion spring, said torsional spring being constructed and oriented such that a predetermined torque applied to the torsion spring will cause it to unwind slightly, which in turn permits the capstan spring to unwind slightly and reduce its grip on the mandrel and permit said drag.

5. The device of claim 3 wherein said drive screw has a threaded portion on the end opposite from said nut, with said second threaded portion having a high lead thread oriented opposite to that of the high lead thread on its other end, and including a second drive nut mating with said drive screw second thread portion and arranged such that a compressive force on said nuts towards one another will cause the cylindrical brake surface to rotate in one direction and a tension force applied to said nuts will cause the cylindrical surface to rotate in the opposite direction.

6. The device of claim 5 including an elongated sleeve-like guide slidably positioned on said second nut in a manner to prevent rotation of the nut relative to the guide, a second torsion spring mounted on and gripping said second guide, and means connecting the second torsion spring to the other end of the capstan spring, said torsion springs being arranged such that one torsion spring controls the unwinding of said capstan spring with one direction of mandrel rotation and the other torsion spring controls the unwinding of the capstan spring with the other direction of mandrel rotation.

7. An energy absorbing device comprising:

a strut having a pair of strut members mounted to move axially with respect to each other;

means for translating axial movement of the strut members into rotation of a mandrel;

a capstan spring having a plurality of coils frictionally gripping said mandrel and arranged so that rotation of the mandrel increases the gripping force when the ends of the spring are stationary; and a pair of torsion springs connected to the ends of the capstan spring to permit unwinding movement of the capstan spring when a predetermined torque is applied to the capstan spring by the mandrel and transmitted to the torsion springs.

8. An energy absorber comprising:

a pair of elongated drive nuts internally threaded on one end with a high lead thread, one of which is a left-handed thread and one of which is a right-handed thread;

a pair of end plugs each connected to the end of a nut opposite to the high lead thread end for connection to apparatus in which motion is to be damped;

a drive screw threaded on opposite ends with a high lead thread which mates with the internal thread in the nuts in a manner such that an axial compression force urging the nuts towards each other is translated into rotation of the drive screw in one direction, whereas a tension force on the nuts pulling the nuts away from each other translates into rotation of the screw in the opposite direction;

a cylindrical mandrel mounted on a central section of the drive screw between the inner ends of the nuts to rotate with the drive screw;

an elongated sleeve-like guide mounted on each of said nuts in a manner that permits the nuts to move axially with respect to the guides but prevents the nuts from rotating relative to the guides;

a capstan spring wound around and frictionally gripping said mandrel;

a torsion spring mounted on and gripping each of said guides with a predetermined force, one end of the torsion spring being anchored to the guide;

a member connecting the other end of one torsion spring to one end of the capstan spring and a member connecting the other end of the other torsion spring to the other end of the capstan spring; and a tubular housing enclosing the springs and fixed to the ends of the guides to prevent rotation of the guides with respect to the housing and thereby hold the capstan spring in gripping relation to the mandrel, the components being arranged in a manner such that the capstan spring prevents rotation of the mandrel in either direction when a load is applied to the strut until the torque on the mandrel is large enough to cause one torsion spring to move slightly and thus allow the capstan spring to unwind enough to permit the gripping force of the capstan spring to be overcome at a level determined by the predetermined force on said one torsion spring.

9. The absorber of claim 8 wherein each of said guides includes an outwardly extending flange on its axially outer end with an axially extending slot formed therein receiving a tang on one axial end of a torsion spring, each of said torsion springs includes a plurality of coils gripping its guide, and said connecting member is a cylindrical member slidably mounted on the guide and having an axially extending slot on the end facing the torsion spring for receiving a tang on the other end of the torsion spring, and a pin extending radially through a hole in each end of the capstan spring anchored in a corresponding hole in the cylindrical guide member and wherein the mandrel includes a recess or socket on each end in which is received the inner end of said guides.

10. A method of absorbing energy comprising:

translating axial movement of a strut member into rotation of one of a cylindrical brake surface and a capstan spring;

applying a frictional force to said cylindrical surface by means of the capstan spring; and employing spring means to enable the capstan spring to unload and reduce its frictional engagement with the brake surface when the force on the strut member reaches a predetermined level.

* * * * *